US012484695B1

(12) United States Patent
Creel

(10) Patent No.: US 12,484,695 B1
(45) Date of Patent: Dec. 2, 2025

(54) SMART VANITY

(71) Applicant: Lisa Creel, Davison, MI (US)

(72) Inventor: Lisa Creel, Davison, MI (US)

( * ) Notice: Subject to any disclaimer, the term of this patent is extended or adjusted under 35 U.S.C. 154(b) by 167 days.

(21) Appl. No.: 18/541,724

(22) Filed: Dec. 15, 2023

Related U.S. Application Data

(60) Provisional application No. 63/432,730, filed on Dec. 15, 2022.

(51) Int. Cl.
*A47B 67/00* (2006.01)
*A47B 21/06* (2006.01)

(52) U.S. Cl.
CPC ..... *A47B 67/005* (2013.01); *A47B 21/06* (2013.01); *A47B 2021/066* (2013.01); *A47B 2220/0077* (2013.01)

(58) Field of Classification Search
CPC ..... A47B 67/00; A47B 67/005; A47B 21/06; A47B 2021/066; A47B 2220/0077; A47B 31/02; A47B 83/02
See application file for complete search history.

(56) References Cited

U.S. PATENT DOCUMENTS

| | | | | |
|---|---|---|---|---|
| 9,122,320 | B1 | 9/2015 | Rowles et al. | |
| D793,099 | S | 8/2017 | Bailey | |
| D872,487 | S | 1/2020 | Choi | |
| 10,602,861 | B2 * | 3/2020 | Meyers | H04N 23/57 |
| D929,749 | S | 9/2021 | Choi | |
| D937,609 | S | 12/2021 | Ramundo | |
| 12,003,851 | B2 * | 6/2024 | Smith | H04R 1/08 |
| 12,364,328 | B1 * | 7/2025 | Blake | H04M 1/04 |
| 2002/0080494 | A1 * | 6/2002 | Meine | A47G 1/02 359/860 |
| 2008/0088214 | A1 * | 4/2008 | Debonis | A47B 67/005 312/348.4 |
| 2013/0145272 | A1 | 6/2013 | Boggie et al. | |
| 2017/0099945 | A1 * | 4/2017 | Meads | A47G 1/00 |
| 2017/0323364 | A1 | 11/2017 | Schmitz-Le Hanne | |
| 2021/0137266 | A1 * | 5/2021 | Pestl | G03B 17/561 |
| 2022/0248876 | A1 * | 8/2022 | Schenker | A47B 67/005 |
| 2024/0324766 | A1 * | 10/2024 | Zhang | A47B 67/005 |

FOREIGN PATENT DOCUMENTS

| | | | | |
|---|---|---|---|---|
| CN | 106690903 A | * | 5/2017 | A47B 67/005 |
| KR | 102718066 B1 | * | 10/2024 | A61L 2/10 |

* cited by examiner

*Primary Examiner* — Daniel J Rohrhoff
(74) *Attorney, Agent, or Firm* — Cramer Patent & Design, PLLC.; Aaron R. Cramer

(57) ABSTRACT

A smart vanity set is presented, comprising a multifunctional vanity table and a complementary vanity seat. The vanity table includes a top surface with an opening covered by a door, multiple drawers within first and second side cabinet assemblies, and a top section with shelving. A notable feature of this set is a movably positioned halo within a rear section pocket of the table. The set also includes a mirror with integrated touchscreen controls, housed within a mirror housing. The vanity seat, designed for comfort and utility, features a seat surface with non-slip material and wheels for mobility. The set integrates technology with a user-friendly interface, including wireless communication transceivers, power supply cords, and controllers for both the table and seat, facilitating a synchronized and interactive user experience.

8 Claims, 8 Drawing Sheets

SMART VANITY

RELATED APPLICATIONS

The present device was first described in and is a continuation of U.S. Provisional Application No. 63/432,730, filed Dec. 15, 2022, the entire disclosures of which are incorporated herein by reference.

FIELD OF THE DEVICE

The present device relates generally to a vanity with multiple selectable smart features operably controlled by a user.

BACKGROUND OF THE DEVICE

The fashion and self-care industry has witnessed unprecedented growth, evolving into an essential social and economic pillar in our lives. This sector encompasses an extensive array of cosmetics, appliances, and innovative techniques, designed not just for enhancing physical appearance but also for promoting body care and disease prevention. Navigating this rich landscape of self-care products and methods, which range from the common to the unique, can be daunting, yet their significance in our daily routines is undeniable.

Amid this plethora of options, one practical solution for integrating these products and techniques into our daily lives is the establishment of a dedicated space. This space serves a dual purpose: it not only organizes and stores a variety of self-care items but also provides a comfortable and compact environment for their application and use. A quintessential example of such a solution is the vanity.

A vanity is ingeniously designed to offer a systematic storage solution for diverse cosmetic products, while also providing a comfortable setting for the application of these products and the practice of various self-care techniques.

Bearing the foregoing in mind, the advent of the smart vanity elevates this concept further, offering a cost-effective and efficient means to integrate the myriad aspects of modern self-care into our daily lives. The smart vanity not only streamlines the self-care process but also enhances the overall experience by merging functionality with comfort.

SUMMARY OF THE DEVICE

The present disclosure encompasses a smart vanity set featuring a vanity table with a top surface that includes an opening and a door. The set comprises a first side cabinet assembly and a second side cabinet assembly, each containing multiple drawers, and a top section assembly equipped with a first and a second shelf.

Additionally, the vanity set incorporates a rear section assembly defining a pocket and a movably positioned halo within this pocket. A mirror, mounted to the top surface and enclosed within a mirror housing, is also included. The set features a vanity seat with a seat surface and wheels for enhanced mobility.

The smart vanity set is powered by a first and a second power cord and managed by a table controller and a seat controller. It includes a first and a second wide area network transceiver for wireless communication, alongside a user interface integrated into the mirror.

In certain configurations, the vanity table's drawers, part of both the first and second side cabinet assemblies, are fitted with power/data outlets, and the top section assembly may house a refrigerator connected to the table controller. The halo, potentially attached to a hinged segmented assembly, can be vertically maneuvered and is designed as a circular element with illumination and hair drying capabilities.

The mirror housing in some configurations features multiple lamps for selective color illumination and a touch-screen interface on the mirror for controller interaction. The vanity seat may include a housing with a display panel and a seat surface designed for weight support and non-slip safety.

Some configurations allow for electrical communication between the vanity table and vanity seat via first and second local transceivers, ensuring synchronized functionality. Additional features in certain configurations include soft-touch or auto-close drawers, photovoltaic materials, high-intensity frequency electromagnetic appliances, digital image capturing devices, and skin analyzers. The construction materials for the vanity set may vary, including plastic moldings, metallic components, wooden materials, or their combinations, with drawers and cabinets optionally designed in semi-circular shapes.

BRIEF DESCRIPTION OF THE DRAWINGS

The advantages and features of the present device will become better understood with reference to the following more detailed description and claims taken in conjunction with the accompanying drawings, in which like elements are identified with like symbols, and in which:

DESCRIPTIVE KEY

Figure 1:
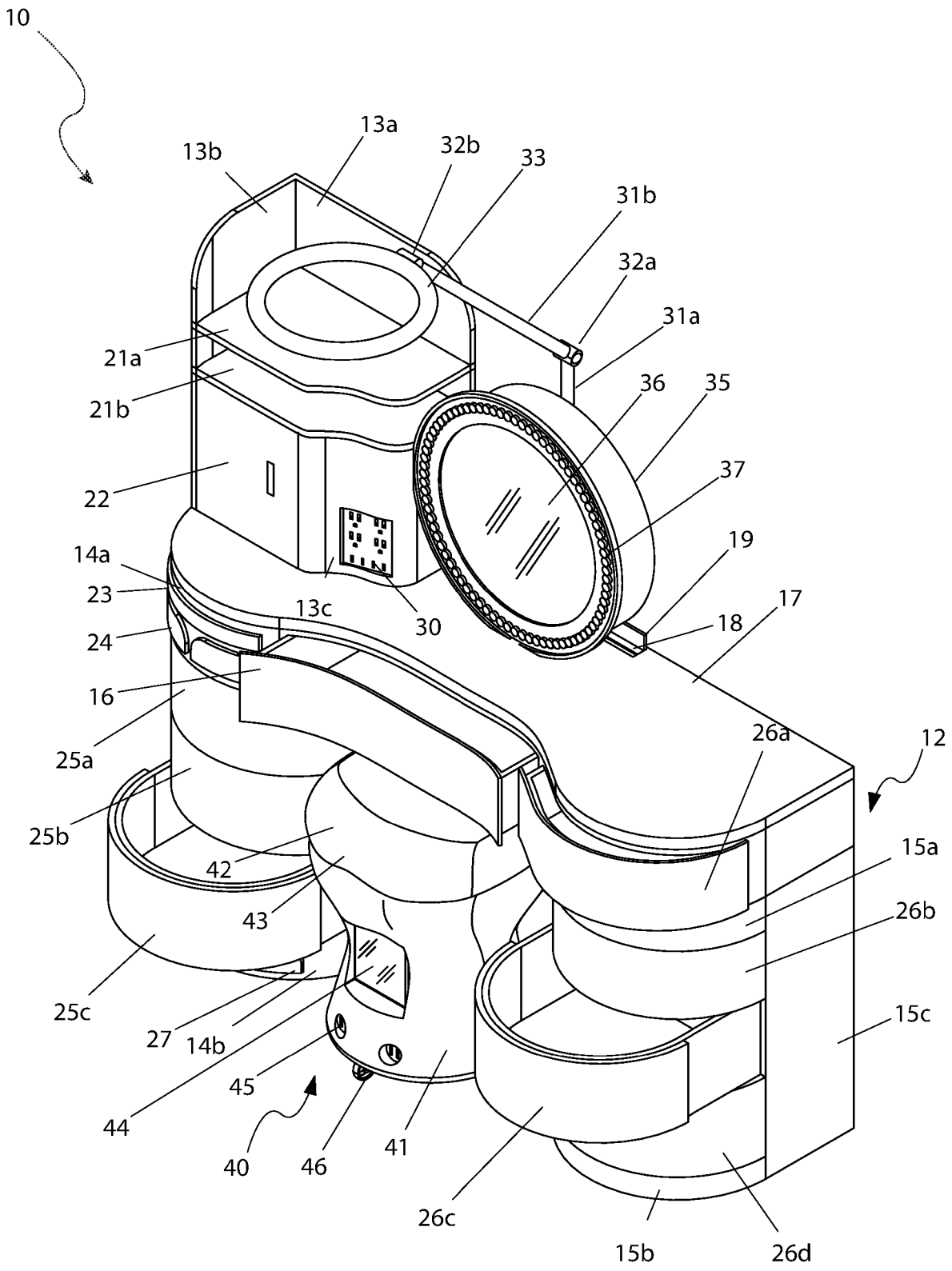
FIG. 1 is a top front right perspective view of a smart vanity set 10, according to a preferred embodiment of the present device.
Figure 2:
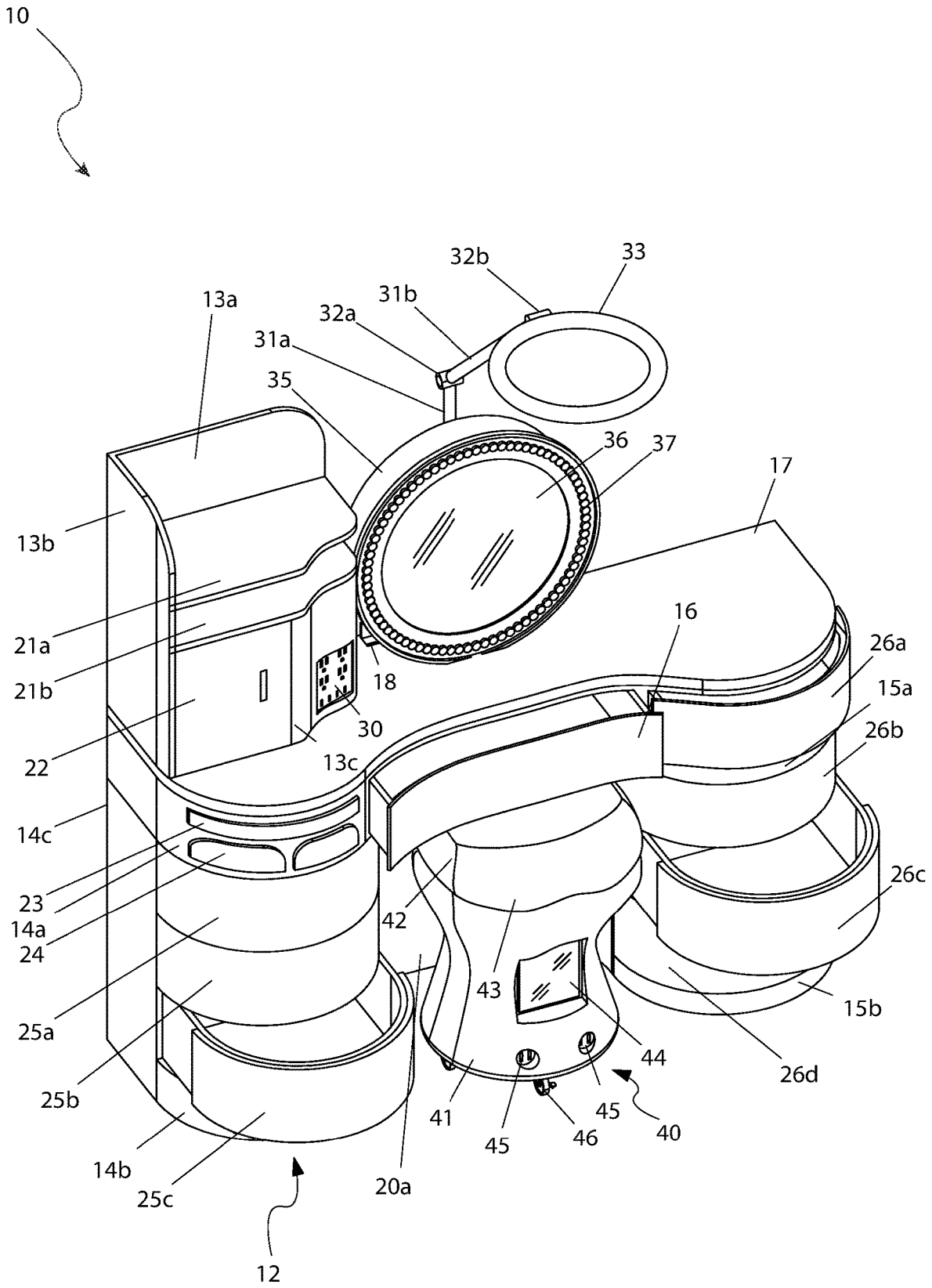
FIG. 2 is a top front left perspective view of the smart vanity set 10, according to a preferred embodiment of the present device.
Figure 3:
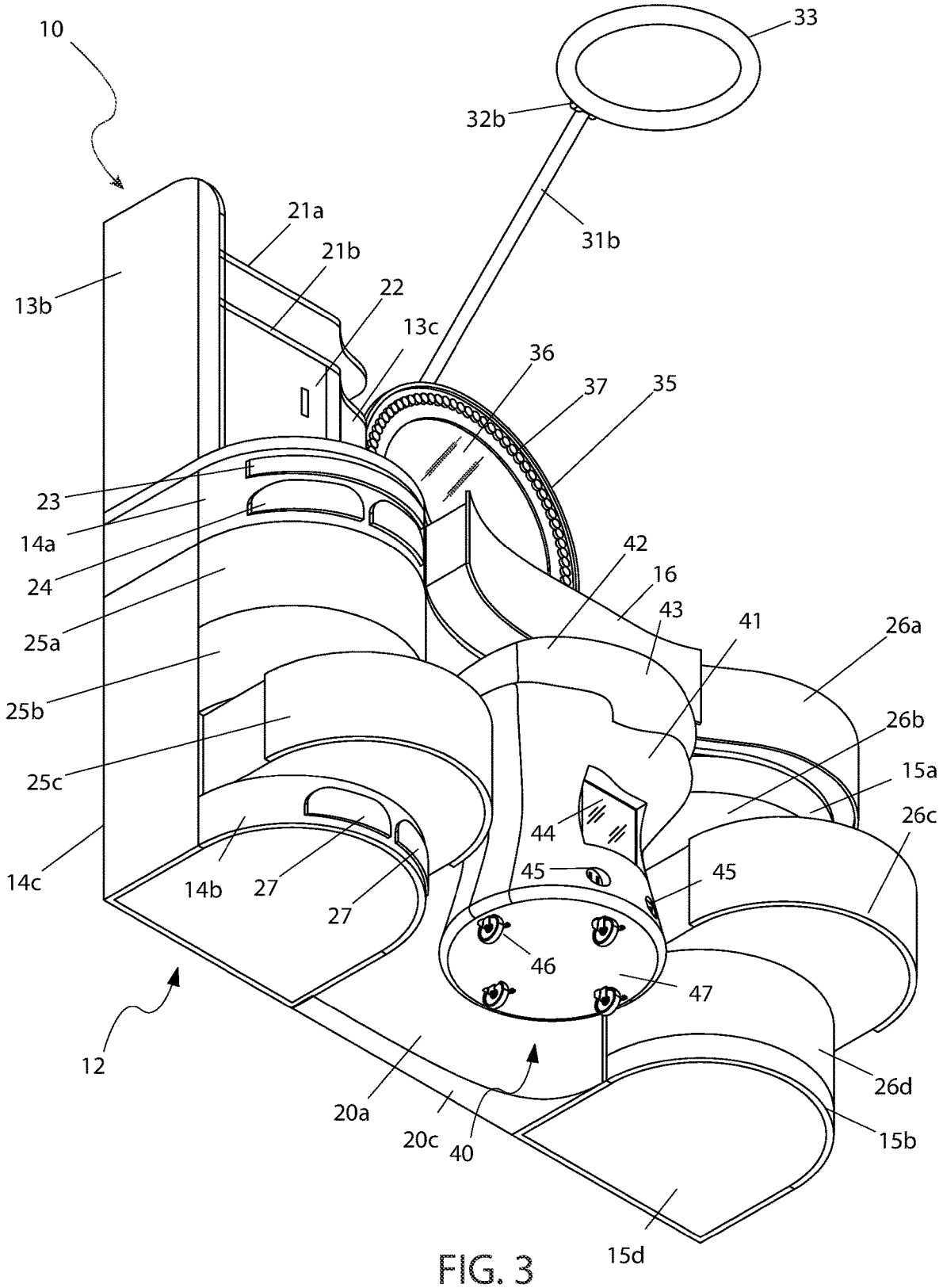
FIG. 3 is a bottom front left perspective view of the smart vanity set 10, according to a preferred embodiment of the present device.
Figure 4:
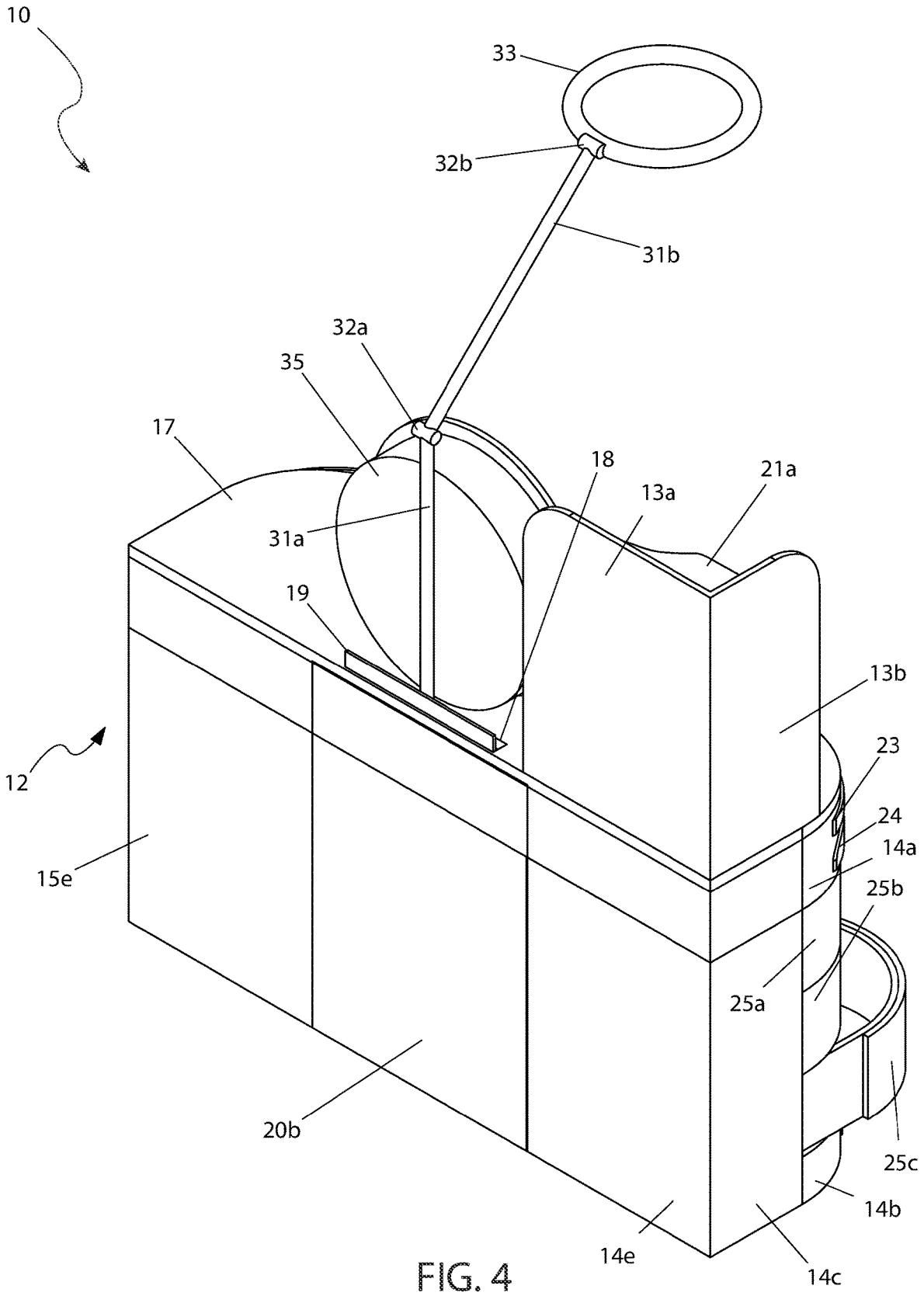
FIG. 4 is a top rear left perspective view of a smart vanity set 10, according to a preferred embodiment of the present device.
Figure 5:
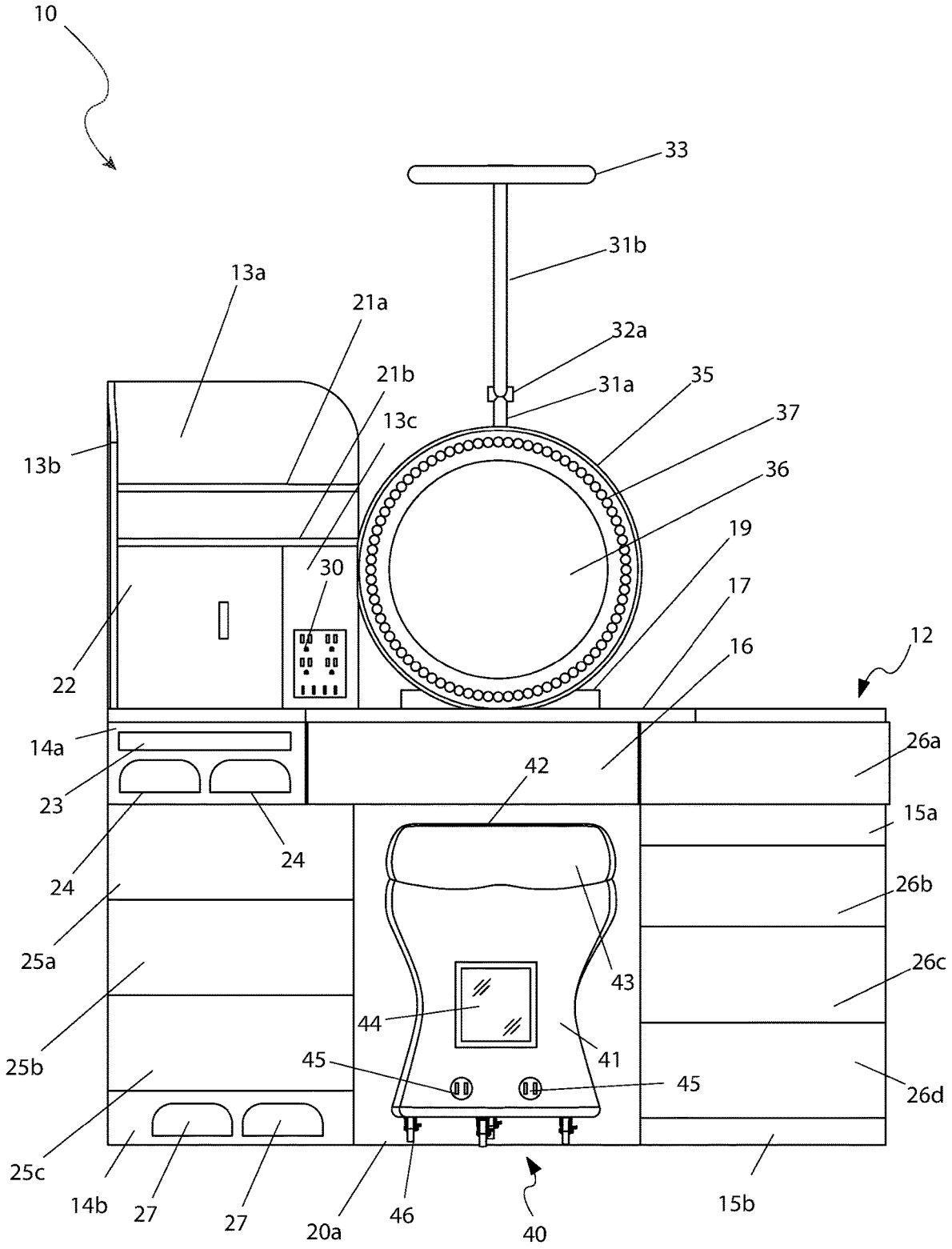
FIG. 5 is a front elevation view of the smart vanity set 10, according to a preferred embodiment of the present device.
Figure 6:
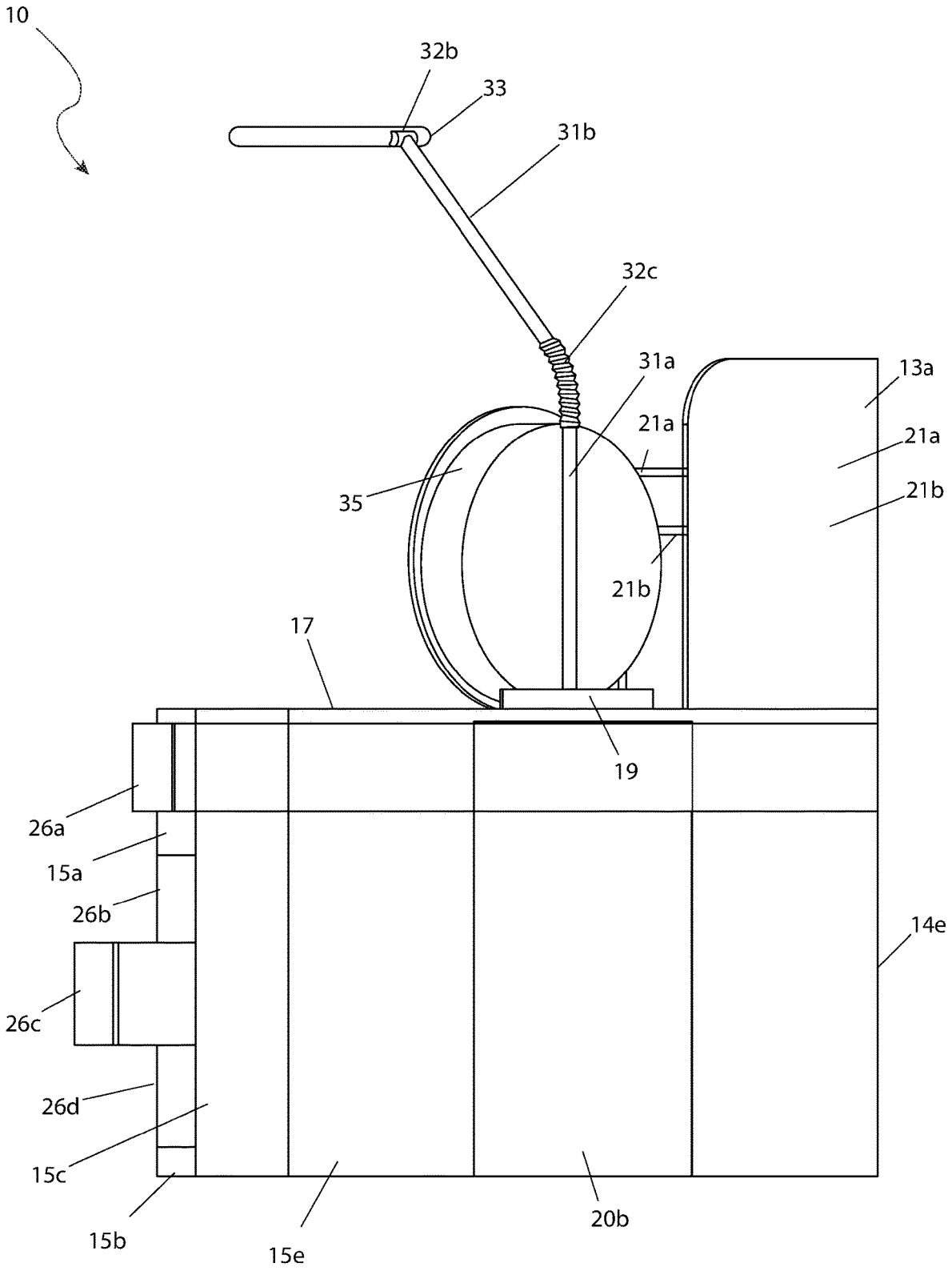
FIG. 6 is a side rear right perspective view of the smart vanity set 10, according to a preferred embodiment of the present device.

10 smart vanity set
12 vanity table
13*a* top section rear panel
13*b* top section first side panel
13*c* top section second side panel
14*a* first side cabinet front top portion
14*b* first side cabinet front bottom panel
14*c* first side cabinet side panel
14*d* first side cabinet bottom panel
14*e* first side cabinet rear panel
15*a* second side cabinet front top panel

15*b* second side cabinet front bottom panel
15*c* second side cabinet side panel
15*d* second side cabinet bottom panel
15*e* second side cabinet rear panel
16 front drawer
17 top surface
18 opening
19 door
20*a* rear section front panel
20*b* rear section rear panel
20*c* rear section bottom panel
21*a* first shelf
21*b* second shelf
22 refrigerator
23 upper first slot
24 upper second slot
25*a* first side first drawer
25*b* first side second drawer
25*c* first side third drawer
26*a* second side first drawer
26*b* second side second drawer
26*c* second side third drawer
26*d* second side fourth drawer
27 lower slot
28 pocket
30 vanity table power supply
31*a* first segment
31*b* second segment
32*a* first hinge
32*b* second hinge
32*c* third hinge
33 halo
34 rail
35 mirror housing
36 mirror
37 lamp
40 vanity seat
41 vanity seat housing
42 seat surface
43 seat base
44 display panel
45 vanity seat power supply
46 wheel
47 vanity seat bottom panel
101 first power cord
105 second power cord
110 table controller
115 power/data outlets
120 digital display driver
125 first wide area network transceiver
130 first local transceiver
135 seat controller
140 second wide area network transceiver
145 second local transceiver

DESCRIPTION OF THE DEVICE

The best mode for carrying out the device is presented in terms of its preferred embodiment, herein depicted within FIGS. 1 through 8. However, the device is not limited to the described embodiment, and a person skilled in the art will appreciate that many other embodiments of the device are possible without deviating from the basic concept of the device and that any such work around will also fall under scope of this device. It is envisioned that other styles and configurations of the present device can be easily incorporated into the teachings of the present device, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

Referring now to FIGS. 1-6, it is shown that the present device describes a smart vanity set 10 that includes a vanity table 12 is capable of storing items in any number of features located thereon. The vanity table 12 is also in wireless electronic communication with the environment via a first wide area network transceiver 125, such as a dedicated application on a personal electronic device or a remote database and is capable of being in electrical communication with a power source via a first power cord 101 to power electronics or electrical appliances either stored on or integrated therewithin. A vanity seat 40 is also an element of the smart vanity set 10. The vanity seat 40 can enjoy the same wireless communication and electrical communication features as the vanity table 12 does, via a second wide area network transceiver 140 and a second power cord 105. The vanity seat 40 is capable of wheeled motion and is particularly suited for enabling a user to set thereupon when concurrently addressing or coming into contact with the vanity table 12.

The vanity table 12 has an overall width and height capable of accommodating a human being that either sits or stands directly adjacent thereto and can be embodied in any desired shape, size, or design. The material of construction of the vanity table 12 can be any material resiliently suited for repeated use, such as plastic moldings, metallic components, wooden or organic materials, or any combination thereof, tending towards the fashionable and/or economically beneficial to manufacture.

Generally, the vanity table 12 includes a first side cabinet assembly 14*a*, 14*b*, 14*c*, 14*d*, 14*e* supporting a plurality of first side drawers 25*a*, 25*b*, 25*c*, a second side cabinet assembly 15*a*, 15*b*, 15*c*, 15*d*, 15*e* supporting a plurality of second side drawers 26*a*, 26*b*, 26*c*, 26*d*, a top surface 17, a top section assembly 13*a*, 13*b*, 13*c*, a rear section assembly 20*a*, 20*b*, 20*c*, a halo 33 movably positionable relative to the rear section 20*a*, 20*b*, 20*c*, a mirror 36 mounted to the top surface 17, and a table controller 110 in electrical communication with a vanity table power supply 30, the halo 33, the mirror 36, and any power/data outlets 115 and configured to be selectively controlled by a user.

The bottom of the top surface 17 has a first end that is fixedly attachable to a top end of a first side cabinet front top panel 14*a*. The bottom of the top surface 17 has a second end, opposite the first end, that is fixedly attachable to a top end of a second side cabinet front top panel 15*a*. a A top end of the front second side cabinet 15 and may also be fixedly attached to the top surface 17. A front portion of the top surface 17 may incorporate a front drawer 16 having a storing means therein, the front drawer 16 movable relative to the top surface 17. Contents of the front drawer 16 can be concealed and supported therein, thereon, or incorporated therewith. The front drawer 16 may comprise at least one (1) power/data outlets 115 each in electrical communication with the table controller 110. In a preferred embodiment, the top surface 17 has a design to fully integrate with the top section assembly 13*a*, 13*b*, 13*c*, the first side cabinet front top panel 14*a*, the second side cabinet front top panel 15*a*, a rear section front panel 20*a*, and a rear section second panel 20*b*. When fixedly attached, the top surface 17 provides a front open space. The height of the vanity table 12 and width of the open space between the first side cabinet assembly 14*a*, 14*b*, 14*c*, 14*d*, 14*e* and second side cabinet assembly 15*a*, 15*b*, 15*c*, 15*d*, 15*e* may enable the position and usage of the vanity seat 40.

The first side cabinet assembly 14*a*, 14*b*, 14*c*, 14*d*, 14*e* is preferably embodied as a four-sided box-like shape, having the first side cabinet front top panel 14*a*, the first side cabinet front bottom panel 14*b*, a pair of first side cabinet side panels 14*c*, a first side cabinet bottom panel 14*d*, and a first side cabinet rear panel 14*e*. The first side cabinet bottom panel 14*d* is configured to contact a horizontal surface, such as a floor. There may be feet to provide stability or casters to provide transportation. A front portion of the first side cabinet front top panel 14*a* may incorporate an upper first slot 23 configured to enable passing of an item to be inserted therein. The upper first slot 23 is immediately subjacent from the top surface 17, and a pair of upper second slots 24 each immediately subjacent the upper first slot 23. Each of the pair of upper second slots 24 is capable of enabling a hand to pass therethrough. The upper first slot 23 and pair of upper second slots 24 may each comprise at least one (1) power/data outlet 115, each in electrical communication with the table controller 110.

The plurality of first side drawers 25*a*, 25*b*, 25*c* reside in the space between the first side cabinet front top panel 14*a* and first side cabinet front bottom panel 14*b*. Immediately subjacent of the pair of upper second slots 24 is a first side first drawer 25*a* movable relative to the pair of first side cabinet side panels 14*c*. Immediately subjacent of the first side first drawer 25*a* is a first side second drawer 25*b* movable relative to the pair of first side cabinet side panels 14*c*. Immediately subjacent of the first side second drawer 25*b* is a first side third drawer 25*c* movable relative to the pair of first side cabinet side panels 14*c*. The first side first drawer 25*a*, first side second drawer 25*b*, and first side third drawer 25*c* each has a storing means, the contents of which can be concealed and supported therein, thereon, or incorporated therewith. Immediately subjacent of the first side third drawer 25*c* is the first side cabinet front bottom panel 14*b*, which incorporates a pair of lower slots 27 each capable of enabling a foot to pass therethrough. Each of the first side first drawer 25*a*, first side second drawer 25*b*, first side third drawer 25*c*, and pair of lower slots 27 may comprise at least one (1) power/data outlet 115, each in electrical communication with the table controller 110. In preferred embodiments, the first side cabinet 14 has a design to fully integrate with the top surface 17, top cabinet 13, second side cabinet 15, and vanity seat 40.

The second side cabinet assembly 15*a*, 15*b*, 15*c*, 15*d*, 15*e* is preferably also embodied as a four-sided box-like shape, having the second side cabinet front top panel 14*a*, the second side cabinet front bottom panel 15*b*, a pair of second side cabinet side panels 15*c*, a second side cabinet bottom panel 15*d*, and a second side cabinet rear panel 15*e*. The second side cabinet bottom panel 15*d* is configured to contact a horizontal surface, such as a floor. There may be feet to provide stability or casters to provide transportation. The second side first drawer 26*a* resides in the space between the bottom of the top surface 17 and the top of the second side cabinet front top panel 15*a*. The remaining second side drawers 26*b*, 26*c*, 26*d* reside in the space between the second side cabinet front top panel 15*a* and second side cabinet front bottom panel 15*b*. The second side first drawer 26*a* is movable relative to the pair of second side cabinet side panels 15*c*. Immediately subjacent of the second side first drawer 26*a* is the second side cabinet front top panel 15*a*. Immediately subjacent the second side cabinet front top panel 15*a* is a second side second drawer 26*b* movable relative to the pair of second side cabinet side panels 15*c*. Immediately subjacent of the second side second drawer 26*b* is a second side third drawer 26*c* movable relative to the pair of second side cabinet side panels 15*c*. Immediately subjacent of the second side third drawer 26*c* is a second side fourth drawer 26*d* movable relative to the pair of second side cabinet side panels 15*c*. The second side fourth drawer 26*d* is immediately superjacent to the second side cabinet front bottom panel 15*b*. The second side first drawer 26*a*, second side second drawer 26*b*, second side third drawer 26*c*, and second side fourth drawer 26*d* each has a storing means, the contents of which can be concealed and supported therein, thereon, or incorporated therewith. Each of the second side first drawer 26*a*, second side second drawer 26*b*, second side third drawer 26*c*, and second side fourth drawer 26*d* may comprise at least one (1) power/data outlet 115, each in electrical communication with the table controller 110.

The top section assembly 13*a*, 13*b*, 13*c* is embodied as a three-sided box-like shape, having a top section real panel 13*a*, a top section first side panel 13*b*, and a top section second side panel 13*c*. The bottom ends of the top section rear panel 13*a*, top section first side panel 13*b*, and top section second side panel 13*b* are fixedly attached to any position on the top of the top surface 17, although preferably this position is aligned with a common bisecting axial centerline with the first side cabinet assembly 14*a*, 14*b*, 14*c*, 14*d*, 14*e* or second side cabinet assembly 15*a*, 15*b*, 15*c*, 15*d*, 15*e*. A first shelf 21*a* includes a floor, a rear wall, and a side wall. The rear end of the first shelf 21*a* is fixedly attached to an inner surface of the top section rear panel 13*a*. The first end of the first shelf 21*a* is fixedly attached to an inner surface of the top section first side panel 13*b*. The bottom end of a second side of the first shelf 21*a* is fixedly attached to a top end of the top section second side panel 13*c*. A second shelf 21*b* includes a floor, a rear wall, and a side wall and resides superjacent to the first shelf 21*a*. The rear end of the second shelf 21*b* is fixedly attached to an inner surface of the top section rear panel 13*a*. The first end of the second shelf 21*b* is fixedly attached to an inner surface of the top section first side panel 13*b*. A refrigerator may removably or fixedly reside within an open space defined between the top surface 17 and the inner sides of the top section first side panel 13*b* and top section second side panel 13*c* and in electrical communication with the table controller 110. Other features of the top section assembly 13*a*, 13*b*, 13*c* may include decorative features, movable features, or contents stored therein, thereon, or integrated therewith. The vanity table power supply 30 may reside on the top section second side panel 13*c* to power any necessary items or contents stored therein, thereon, or integrated therewith.

The rear section front panel 20*a* has a first end fixedly attachable to an inner surface of an inner first side cabinet side panel 14*c* and a second side fixedly attachable to an inner surface of an inner second side cabinet side panel 15*c*. A rear section rear panel 20*b* has a first end fixedly attachable to a first side cabinet rear panel 14*e* and a second side fixedly attachable to a second side cabinet rear panel 15*e*. The rear section rear panel 20*b* may in some embodiments comprise a continuous panel with the first side cabinet rear panel 14*e* and second side cabinet rear panel 15*e*. A rear section bottom panel 20*c* is affixed to the bottom ends of the rear section front panel 20*a* and rear section rear panel 20*b*.

A pocket 28 is defined as the space between the rear section front panel 20*a*, rear section rear panel 20*b*, rear section bottom panel 20*c*, and top surface 17.

Figure 7:
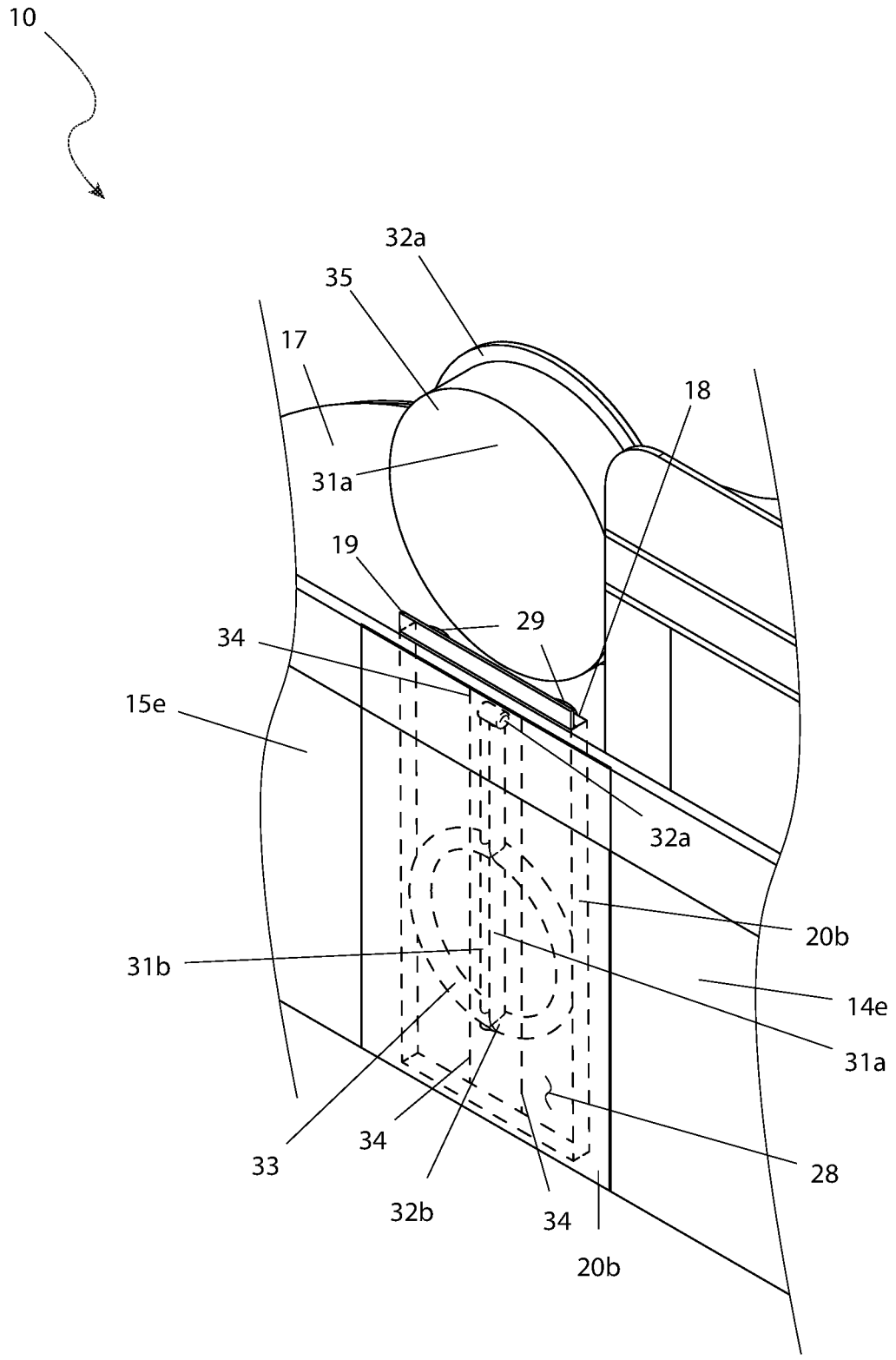
FIG. 7 is a partial top rear left perspective view of the smart vanity set 10 with a cutout portion of the rear section rear panel 20*b*, showing the pocket 28 and the halo 33 stored thereon, according to a preferred embodiment of the present device; and, FIG. 8 is an electrical schematic of the smart vanity set 10, according to a preferred embodiment of the present device.

Referring now more closely to FIG. 7, the halo 33 is attached to a hinged segmented assembly 31*a*, 31*b*, 32*a*, 32*b*, 32*c* that is vertically motionable to either fully retract into total concealment within the pocket 28 between the rear section front panel 20*a* and rear section rear panel 20*b* or fully extend outwardly therefrom. An opening 18 in the top surface 17 is selectively coverable by a door 19 to provides environmental communication with the pocket 28. Within the pocket 28 is a positioning mechanism such as a pair of rails 34 fixedly attached to the rear section front panel 20*a* and/or rear section rear panel 20*b*. A first end of a first segment 31*a* is movably attached between the pair of rails 34 and is captured therein, such that there is a stop to prevent total removal of the first segment 31*a* therefrom during normal manipulation thereof. The opposing second end of the first segment 31*a* is movably attached to a first end of a first hinge 32*a*. In certain embodiments, a third hinge 32*c* is movably attached to the first segment 31*a*, embodied as an articulating section (see FIG. 6). The opposing second end of the first hinge 32*a* (or third hinge 32*c*) is movably attached to a first end of a second segment 31*b*. The opposing second end of the second segment 31*b* is movably attached to a first end of a second hinge 32*b*. The opposing second end of the second hinge 32*b* is movably attached to a halo 33, preferably configured as a circular element that incorporates an illumination means and a hair drying device. The halo 33 is in electrical communication with the table controller 110.

The mirror 36 is housed within a mirror housing 35 and is visible from the front of the vanity table 12. The mirror housing 35 has a bottom end fixedly or removably connected to the top surface 17, preferably coaxially aligned with the center of the opening 18 and not interfering with operation of the door 19. A plurality of lamps 37 may be attached to or integrated within the mirror housing 35 or mirror 36. The mirror 36 and plurality of lamps 37 are in electrical communication with the table controller 110. In the exemplary embodiment, the mirror housing 35 is circular and may further include a mirror cabinet capable of having decorative features, movable features, or contents stored therein, thereon, or integrated therewith. In the exemplary embodiment, the mirror housing 35 has a movable lid providing access to the contents therein. The mirror 36 can incorporate a touchscreen user interface enabling selective operative control of the table controller 110 to control various features of the smart vanity set 10. It is appreciated that when in full extension, the positioning of the halo 33 is hingedly motionable relative to a common bisecting axial centerline passing through the centers of the opening 18 and the mirror 36 and configured to be positioned over a head of a user sitting on the vanity seat 40 at the vanity table 12. In other embodiments, the halo 33 can pivot in three (3) dimensions relative to the second hinge 32*b*. In some embodiments, the positioning mechanism may incorporate a motor in electrical communication with the table controller 110.

The vanity seat 40 includes a vanity seat housing 41 having a seat surface 42, a seat 43, a display panel 44, and a vanity seat power supply 45. The vanity seat housing 41 is preferably a generally cylindrical hollow device that has an open top and a vanity seat bottom panel 47. Rotatably attached to the bottom surface of the vanity seat bottom panel 47 is at least one (1) wheel 46, thereby enabling the vanity seat 40 to be physically moved. The seat 43 is solid and removably attached to the upper portion of the vanity seat housing 41 to totally cover the open top and is capable of being in environmental communication with the interior of the vanity seat housing 41 or contents stored therein. A seat surface 42 is removably attached or permanently affixed to the top of the seat base 43 and is preferably a soft and structurally sound material capable of withstanding the weight of a user sitting thereon (e.g., up to four hundred pounds (400 lb.)) and may or may not have non-slip material. The display panel 44 is preferably a touchscreen device integrated within the side wall of the vanity seat housing 41 and in electrical communication with a seat controller 135. The vanity seat power supply 45 may be located on the side wall of the vanity seat housing 45 and may number one (1) or more. Similarly, the vanity seat power supply 45 is in electrical communication with the seat controller 135 to power any power/data outlets 115, necessary items, or contents stored therein, thereon, or integrated therewith.

Figure 8:
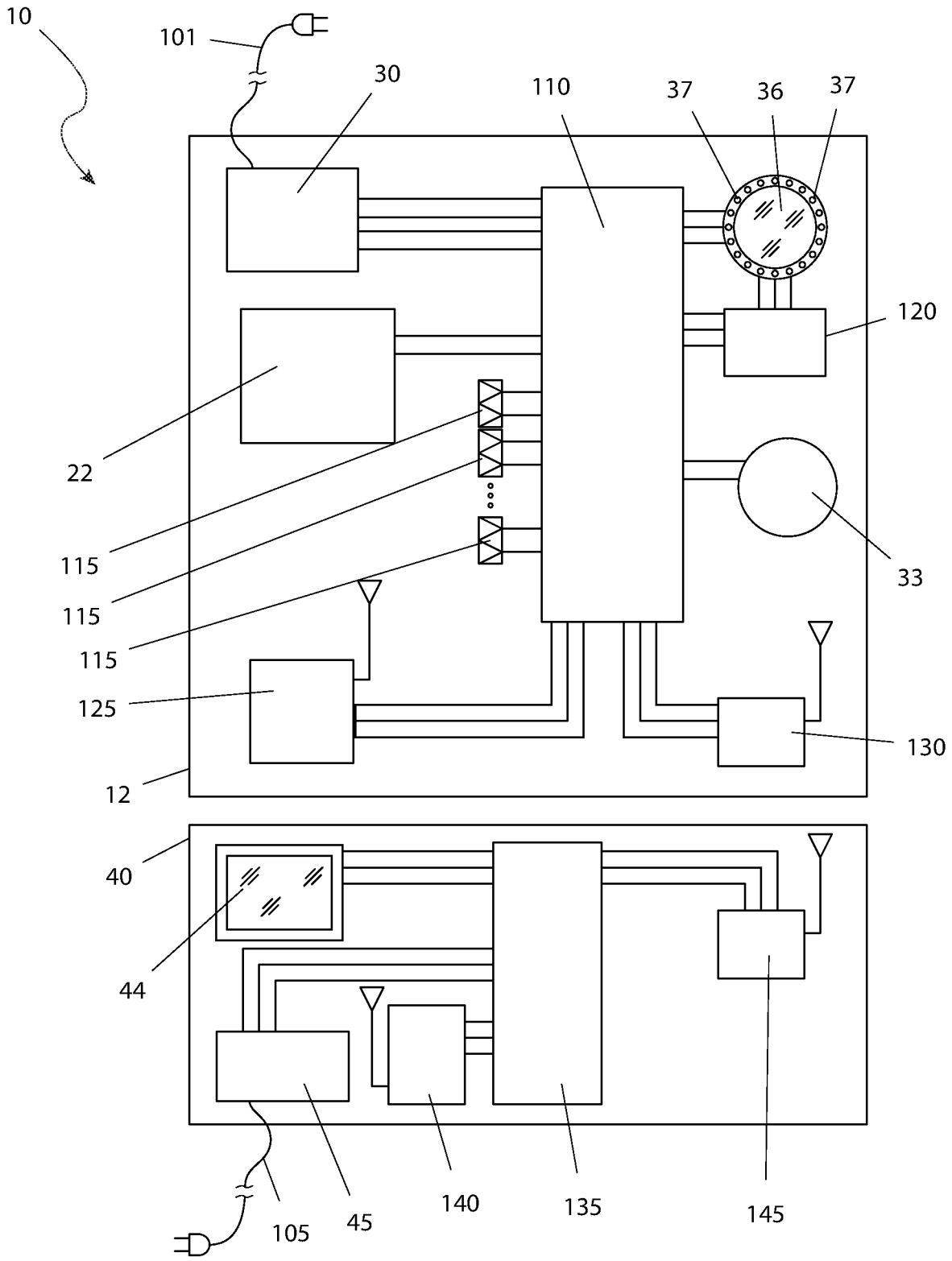

Referring now to FIG. 8, electrical power for the vanity table 12 is provided by a first power cord 101 which powers the vanity table power supply 30. Similarly, electrical power for the vanity seat 40 is provided by a second power cord 105, which powers the vanity seat power supply 45. Resultant power from the vanity table power supply 30 of varying voltages and current levels is routed to the table controller 110, envisioned to be a single board computer (SBC), capable of handling input and output instructions along with logic. Outputs are provided to the lamp 37, the halo 33, the refrigerator 22, and a multitude of power/data outlets 115, located in the various first side drawers 25*a*, 25*b*, 25*c*, and second side drawers 26*a*, 26*b*, 26*c*, 26*d* and the opening 18 of the vanity table 12. Input and output signals are also provided to a digital display driver 120 which in turn operates the mirror 36. Inputs such as touch screen commands are envisioned. A first wide area network transceiver 125, envisioned to be Wi-Fi internet, Bluetooth, or the like, also provides input and output signaling to the table controller 110 and allows for access to and from the functionality of the smart vanity 10 to exterior devices such as the Internet, a smart phone, tablet computer or the like. A first local transceiver 130 provides electrical communication to the vanity seat 40.

Resultant power from the vanity seat power supply 45, of varying voltages and current levels is routed to a seat controller 135, envisioned to be a single board computer (SBC), capable of handling input and output instructions along with logic. Input and output signals are provided to the display panel 44, which in turns operates the functionality of the vanity seat 40. Inputs such as touch screen commands are envisioned. A second wide area network transceiver 140, envisioned to be Wi-Fi internet, Bluetooth, or the like, also provides input and output signaling to the seat controller 135 and allows for access to and from the functionality of the vanity seat 40 to exterior devices such as the Internet, a smart phone, tablet computer or the like. A second local transceiver 145 provides electrical communication back to the vanity table 12 via the first local transceiver 130, as aforementioned described.

The first side drawers 25*a*, 25*b*, 25*c*, and second side drawers 26*a*, 26*b* 26*c*, 26*d* in a preferred embodiment may comprise semi-circular shapes. Other more specialized features of the smart vanity set 10 may comprise soft-touch, or auto-close drawers 25*a*, 25*b*, 25*c*, 26*a*, 26*b*, 26*c*, 26*d*, control interfaces, power/data outlets 115 incorporating or capable of being in electrical communication with personal electronic devices, materials exhibiting photovoltaic features, high-intensity frequency electromagnetic appliances, digital image capturing, skin analyzers, 3-D nail art, selective color illumination for the plurality of lamps 37, calendar display on the mirror 36 or mirror housing 35.

The foregoing descriptions of specific embodiments of the present device have been presented for purposes of illustration and description. They are not intended to be exhaustive or to limit the device to the precise forms disclosed, and obviously many modifications and variations are possible in light of the above teaching. The embodiments were chosen and described in order to best explain the principles of the device and its practical application, to thereby enable others skilled in the art to best utilize the device and various embodiments with various modifications as are suited to the particular use contemplated.

What is claimed is:

1. A smart vanity set comprising:

a vanity table with a top surface having an opening and a door, a first side cabinet assembly and a second side cabinet assembly each comprising multiple drawers, a top section assembly with a first shelf and a second shelf, a rear section assembly defining a pocket, a halo movably positioned within the pocket, a mirror mounted to the top surface and housed within a mirror housing, a vanity seat including a seat surface and wheels, a first power cord and a second power cord for electrical power supply, a table controller and a seat controller for managing the smart vanity set, a first wide area network transceiver and a second wide area network transceiver for wireless communication, and a user interface incorporated into the mirror.

2. The smart vanity set of claim 1, wherein the vanity table includes power/data outlets in each drawer of both the first and second side cabinet assemblies, and the top section assembly includes a refrigerator in electrical communication with the table controller.

3. The smart vanity set of claim 1, wherein the halo is attached to a hinged segmented assembly that is vertically motionable, and the halo is configured as a circular element incorporating illumination means and a hair drying device.

4. The smart vanity set of claim 1, wherein the mirror housing includes a plurality of lamps providing selective color illumination, and the mirror incorporates a touchscreen user interface for controlling the table controller.

5. The smart vanity set of claim 1, wherein the vanity seat includes a vanity seat housing with a display panel, and the seat surface is designed to support a user's weight and includes non-slip material.

6. The smart vanity set of claim 1, wherein the first local transceiver and the second local transceiver provide electrical communication between the vanity table and the vanity seat for synchronized operation and control.

7. The smart vanity set of claim 1, further comprising soft-touch or auto-close drawers, materials with photovoltaic features, high-intensity frequency electromagnetic appliances, digital image capturing devices, and skin analyzers.

8. The smart vanity set of claim 1, wherein the vanity set is constructed from materials including plastic moldings, metallic components, wooden materials, or a combination thereof, and the drawers and cabinets are configured in semi-circular shapes.

* * * * *